United States Patent [19]

Roth et al.

[11] 4,368,367

[45] Jan. 11, 1983

[54] GAS-BLAST SWITCH

[75] Inventors: Adrian W. Roth, Aarau; Hans-Rudolf Wüthrich, Oberentfelden, both of Switzerland

[73] Assignee: Sprecher & Schuh AG, Aarau, Switzerland

[21] Appl. No.: 183,428

[22] Filed: Sep. 2, 1980

[30] Foreign Application Priority Data

Mar. 10, 1980 [EP] European Pat. Off. ..... 80101206

[51] Int. Cl.[3] ..... H01H 33/88

[52] U.S. Cl. ..... 200/148 A; 200/150 G

[58] Field of Search ..... 200/148 A, 150 G

[56] References Cited

U.S. PATENT DOCUMENTS 2,055,312 9/1936 Ruppel ..... 200/148 A 2,459,599 1/1949 Strom ..... 200/150 G

FOREIGN PATENT DOCUMENTS 516532 1/1940 United Kingdom ..... 200/148 A

*Primary Examiner*—Robert S. Macon

*Attorney, Agent, or Firm*—Werner W. Kleeman

[57] ABSTRACT

A fixed contact element and a movable contact element can be brought into and out of engagement with one another within a switching chamber. The switching chamber flow communicates, on the one hand, by means of a blast nozzle, closed by the movable contact element in the cut-on position of the gas-blast switch, with an expansion chamber and, on the other hand, flow communicates by means of a check or a non-return valve which opens in the direction of the switching chamber, with the pressure side of a pump cylinder arranged in the expansion chamber. Operatively associated with the pump cylinder is a movable pump piston which pressurizes the pump cylinder during a cut-off stroke with a time-delay. To reduce the constructional expenditure and to increase the operational reliability the pump piston is rigidly connected with the movable contact element, whereas the length of the pump cylinder is less than the switching stroke of the movable contact element, so that the pump piston is located externally of the pump cylinder at the region of the cut-on position of the gas-blast switch.

9 Claims, 1 Drawing Figure

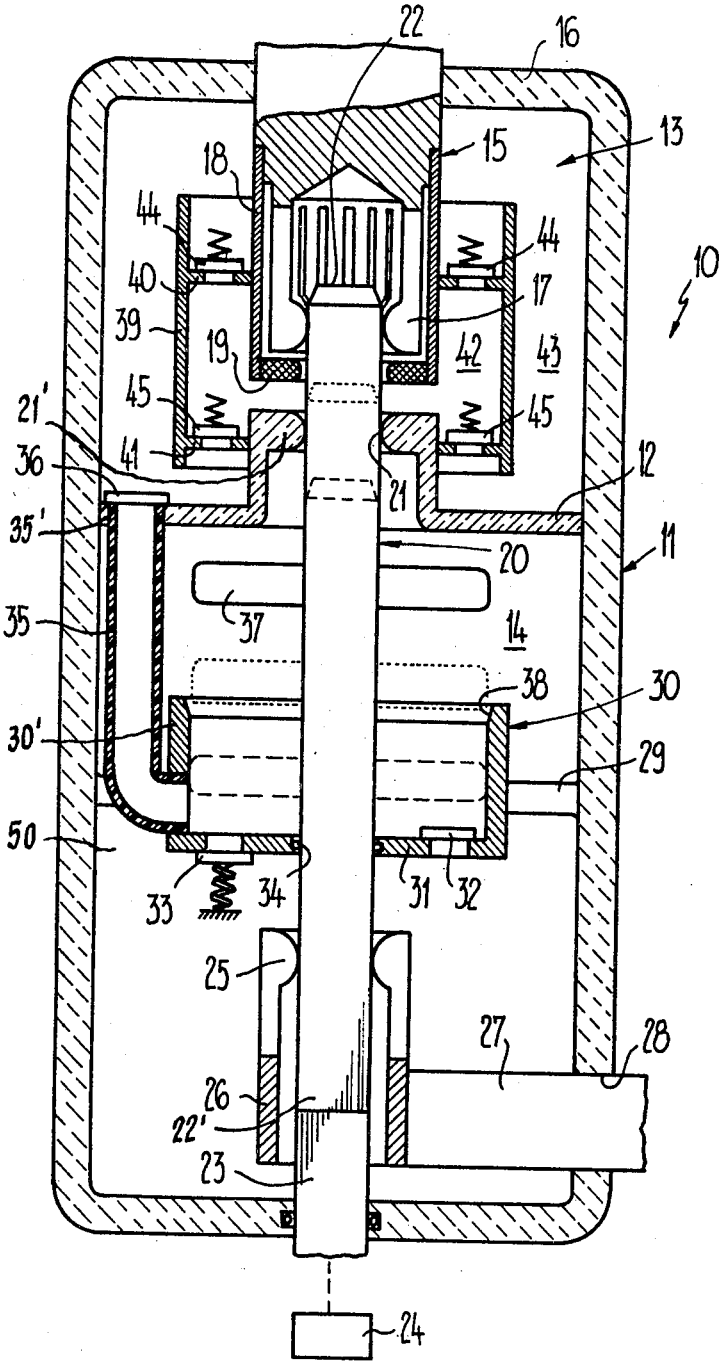
22
16
13
15
18
44
44
10
40
17
39
19
42
43
45
45
21'
36
41
21
12
35'
20
11
37
14
35
38
30
30'
29
50
33
34
31
32
25
27
28
26
22'
23
24

GAS-BLAST SWITCH

BACKGROUND OF THE INVENTION

The present invention relates to a new and improved construction of a gas-blast switch.

Generally speaking, the gas-blast switch of the present development is of the type comprising a stationary contact element and a movable contact element which can be brought into and out of engagement with one another within a switching chamber. The switching chamber flow communicates, on the one hand, by means of a blast nozzle, which is closed in the cut-on position of the gas-blast switch by the movable contact element, with an expansion chamber and, on the other hand, flow communicates by means of the non-return or check valve which is open towards the switching chamber with the pressure side of a stationary pump cylinder arranged within the expansion chamber. Operatively associated with this pump cylinder is a movable pump piston which, during a cut-off stroke of the gas blast switch pressurizes the pump cylinder with a time-delay.

Such type gas-blast switch is known, for instance, from FIG. 2 of German Patent Publication No. 2,750,762. With this prior art gas-blast switch the desired time delay of the actual pumping stroke of the pump piston is realized in that, the movable contact element and its switching rod, respectively, are coupled by a spring-loaded drag connection with the pump piston. Hence, during a cut-off stroke the pump piston initially then begins to carry out its pumping stroke when the movable contact element and its switching rod have moved through a part of the cut-off stroke which is determined by the nature of the drag connection. The time-delay of the pumping stroke is desired because there is not required pressurized extinguishing gas for blowing of the formed switching art immediately at the start of the cut-off stroke, so that the power output which must be applied by the switch drive for performing the pumping stroke initially is completely available for accelerating the movable components of the switch out of the cut-on position.

Therefore, with the state-of-the-art switch the pump piston is movable to a limited degree in relation to the movable contact element and its switching rod, and furthermore, the drive, at the start of the cut-off stroke, must overcome the force of a spring provided at the drag connection. If, however, for some reason, whether such be because of faulty lubrication or because of binding due to deposition of abraded particles, the mobility of the pump piston in relation to the movable contact element is no longer completely insured for, i.e. if the drag connection no longer functions or only hesitatingly functions, then with the heretofore known gas-blast switch the pump or pumping stroke begins at the start of the cut-off stroke, in other words too early, so that the power output of the switch drive possibly is no longer adequate.

SUMMARY OF THE INVENTION

Therefore, with the foregoing in mind it is a primary object of the present invention to provide a new and improved construction of a gas-blast switch which is not associated with the aforementioned drawbacks and limitations of the prior art proposals.

Another and more specific object of the present invention aims at providing a new and improved construction of a gas-blast switch of the previously mentioned type which, while dispensing with the use of a drag connection, nonetheless ensures for application of the pumping stroke with a time-delay.

Now in order to implement these and still further objects of the invention, which will become more readily apparent as the description proceeds, the proposed gas-blast switch of the present development is manifested by the features that the pump piston is rigidly connected with the movable contact element and the length of the pump cylinder is less than the switching stroke of the movable contact element, so that the pump piston is located externally of the pump cylinder at the region of the cut-on position of the gas-blast switch.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE shows a schematic axial sectional view through a gas-blast switch according to the present invention.

DETAILED DESCRIPTION OF THE PREFERRED EMBODIMENTS

Describing now the drawing, the illustrated exemplary embodiment of gas-blast switch 10 will be seen to comprise a housing 11 which is tightly encapsulated towards the outside and formed of a suitable electrically insulating material. This housing 11 is filled with an appropriate extinguishing gas, for instance, typically $SF_6$. The housing 11 has an internal space or compartment, generally indicated by reference character 50, which is divided by a partition or separation wall 12 into a switching chamber 13 and into an expansion chamber 14. Within the switching chamber 13 there is arranged a stationary contact 15 which extends out of the housing 11 through the upper end wall 16 and is anchored at such end wall 16. The stationary contact 15 possesses a rim of resilient contact fingers 17 or the like which, while retained by a conductive sleeve 18 surrounding the rim of contact fingers 17, has located forwardly thereof a burn-off ring 19.

A movable, pin-shaped contact element 20 extends—in the full line illustrated cut-on position—through a hub-like passageway 21' formed in the partition wall 12 and acting as a blast nozzle 21. The pin-shaped contact element 20 engages by means of its free end 22 into the rim of contact fingers 17. The movable contact element 20 extends coaxially through the expansion chamber 14 and is coupled at its lower end 22', by means of an insulating switching rod 23 with a suitable and therefore purely schematically illustrated drive 24. By means of this drive 24 it is possible to axially displace the movable contact element 20. At the region of its lower end 22' the movable contact element 20 is guided through a set of sliding contacts 25 which, in turn, are attached to a ring 26 forming the inner end of a connection line or conductor 27. This connection line 27 is sealingly attached at location 28 in the housing 11 and laterally protrudes out of such housing.

Now within the expansion chamber 14 there is arranged a pump cylinder 30, for instance stationarily retained with respect to the housing 11 by means of radial struts 29 or equivalent supporting structure. At the base or floor 31 of the pump cylinder 30 there is mounted a merely schematically indicated suction valve 32 as well as a spring-loaded excess or overpressure valve 33 which opens towards the exterior of the pump cylinder 30. Furthermore, at the floor 31 there is provided a throughpass bore 34 equipped with a suitable seal serving for the throughpassage of the movable contact element 20. A pressure line or conduit 35 extends from the part of the side wall 30' of the pump cylinder 30 which neighbors the cylinder base or floor 31. This pressure line or conduit 35 extends through the partition or separation wall 12 into the switching chamber 13 and is provided at its end 35' with a check or non-return valve 36 which opens in the direction of the switching chamber 13.

At the movable contact element 20 there is fixedly anchored a pump piston 37 which, in the cut-on position of the gas-blast switch, is located externally of the pump cylinder 30 provided with a countersunk portion 38. Only when the movable contact element 20 reaches the momentary position indicated with dots, corresponding approximately to the minimum extinguishing distance, does the pump piston 37 travel into the pump cylinder 30 and then displaces the extinguishing gas contained within the pump cylinder 30 until there has been reached the broken line cut-off position.

The stationary contact element 15 and the blast nozzle 21 are surrounded by a hollow cylinder 39. The ring-shaped end walls 40 and 41 of the hollow cylinder 39, which are somewhat inset or rearwardly shifted with respect to its base lines, are secured to the outer surface of the sleeve member or sleeve 18 and the blast nozzle 21, respectively. Therefore, this hollow cylinder 39 subdivides the switching chamber 13 by means of its end walls 40 and 41 into an actual arc chamber 42 directly containing the switching path and into a pressure storage chamber 43 having a larger volume.

Mounted at the end wall 40 are spring-loaded excess pressure valves 44 which open towards the pressure storage chamber 43, whereas there are mounted at the end wall 41 check or non-return valves 45 which open in the direction of the arc chamber 42.

Having now had the benefit of the foregoing description of the gas-blast switch of this development its mode of operation will now be considered and is as follows:

During a cut-off stroke the movable contact element 20 is moved from the position shown in full lines in the drawing into the broken line indicated position. The blowing of the arc which is drawn between the free end 22 of the contact element 20 and the burn-off ring 19 now is accomplished by different quantities of extinguishing gas, depending upon the current intensities which are to be cut-off.

In the presence of small current intensities and along therewith less intensive switching arcs such produce within the arc chamber 42 a comparatively modest pressure increase, which is not sufficient to cause response of the excess pressure valves 44. As soon as the blast nozzle 21 has been freed by the downwardly moving contact element 20, this switching arc initially is blown by the extinguishing gas which has been pressurized within the arc chamber 42, so that towards the end of the cut-off stroke there is available fresh extinguishing gas which has been displaced out of the pump cylinder 30 by means of the pressure line 35 into the pressure storage chamber 43, which then opens the check valves 36 and 45.

In the presence of intermediate current intensities the pressure increase at the arc chamber 42 is greater, so that part of this greater compressed extinguishing gas escapes out of the arc chamber 42 through the excess pressure valves 44 upwardly into the pressure storage chamber 43. Consequently, also the entire pressure storage chamber 43 experiences a pressure increase, wherein, however, at its lower region there is still located fresh, uncontaminated extinguishing gas. Now as soon as the movable contact element 20 frees the blast nozzle 21, then the pressure emanating from the arc chamber 42 immediately discharges through the blast nozzle 21, and so-to-speak there simultaneously open the check valves 45, so that practically fresh extinguishing gas flows out of the pressure storage chamber 43 and likewise blows the switching arc. This happens before the extinguishing gas displaced out of the pump cylinder 30 comes into play.

In the presence of still higher current intensities the blowing of the switching arc occurs in a similar manner, wherein however the extinguishing gas displaced out of the pump cylinder comes into play somewhat later in time, because the increased pressure in the pressure storage chamber 43 initially retains the check valve 36 closed. So that in this case there does not arise any too high pressure within the pump cylinder 30—which could result in overloading of the drive 24—there is provided the excess pressure valve 33 which then opens as long as the pressure in the pressure storage chamber 43 is still greater than the pressure in the pump cylinder 30 (with the result that the non-return or check valve 30 still remains closed) which, in turn, is sufficiently great in order to overcome the spring force of the excess pressure valve 33.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A gas-blast switch comprising:

means defining a gas-blast housing containing a switching chamber and an expansion chamber;

a stationary contact element;

a movable contact element;

means for placing said stationary contact element and said movable contact element into and out of engagement with one another within said switching chamber;

a blast nozzle cooperating with said movable contact element and closed by said movable contact element in a cut-on position of said gas-blast switch;

said switching chamber flow communicating by means of said blast nozzle with said expansion chamber;

a pump cylinder stationarily arranged within said expansion chamber;

said pump cylinder including a pressure side;

means including a check valve open in the direction of said switching chamber for connecting said switching chamber with said pressure side of said pump cylinder;

a movable pump piston operatively associated with said pump cylinder;

said movable pump piston pressurizing with a time-delay the pump cylinder during a cut-off stroke of the gas-blast switch;

said pump piston being rigidly connected with said movable contact element; and the length of said pump cylinder being less than a switching stroke of said movable contact element, so that the pump piston is located externally of the pump cylinder at the region of a cut-off position of said gas-blast switch.

2. The gas-blast switch as defined in claim 1, wherein:

said pressure side of said pump cylinder contains a pressure chamber; and a spring-loaded excess pressure valve opening in the direction of said expansion chamber and provided in cooperative relationship with respect to said pressure chamber of said pump cylinder.

3. The gas-blast switch as defined in claim 2, wherein:

said excess pressure valve is mounted at said pump cylinder.

4. The gas-blast switch as defined in claim 1, wherein:

the length of an idle stroke through which moves the pump piston from the cut-on position until entry of the pump piston into the pump cylinder during the course of a cut-off stroke of the gas-blast switch approximately corresponds to a minimum arc extinguishing distance.

5. The gas-blast switch as defined in claim 1, further including:

wall means surrounding the stationary contact element and the blast nozzle for subdividing the switching chamber into an arc chamber and a pressure storage chamber;

the pressure side of said pump cylinder flow communicating with said pressure storage chamber; and at least one spring-loaded excess pressure valve open in the direction of the pressure storage chamber and at least one spring-loaded check valve open in the direction of the arc chamber for operatively connecting the pressure storage chamber with the arc chamber.

6. The gas-blast switch as defined in claim 5, wherein:

the spring-loading of the excess pressure valve which opens towards the pressure storage chamber is different than the spring-loading of the check valve open towards the arc chamber.

7. The gas-blast switch as defined in claim 6, wherein:

the spring-loading of the check valve open towards the arc chamber is less than the spring-loading of the excess pressure valve open towards the pressure storage chamber.

8. The gas-blast switch as defined in claim 5, wherein:

the volume of the arc chamber is less than the volume of the pressure storage chamber.

9. The gas-blast switch as defined in claim 1, wherein:

the spacing of the pump cylinder from the closed position of the blast nozzle is less than the spacing of the pump piston to a free end of the movable contact element.

* * * * *